United States Patent [19]

Maggio

[11] Patent Number: 4,974,265

[45] Date of Patent: Dec. 4, 1990

[54] COLLAPSIBLE PRIVACY SHELTER

[76] Inventor: John J. Maggio, 981 W. Latimer Ave., Campbell, Calif. 95008

[21] Appl. No.: 398,835

[22] Filed: Aug. 25, 1989

[51] Int. Cl.[5] ..... A47K 11/02; A47K 3/022

[52] U.S. Cl. ..... 4/449; 4/459; 4/460; 4/599; 4/661; 135/106; 135/901; 135/902; 135/88

[58] Field of Search ..... 4/599, 600, 612, 449, 4/459, 601, 596, 597, 604, 605, 618, 616, 460, 461, 462, 463; 52/67, 245-246, 79.5, DIG. 14, 160; 135/901, 902, 87-88

[56] References Cited

U.S. PATENT DOCUMENTS

| | | | |
|---|---|---|---|
| 1,917,629 | 7/1933 | Anderson . | |
| 2,563,886 | 8/1951 | Taylor | 52/67 X |
| 2,635,302 | 4/1953 | Denning | 52/67 X |
| 2,739,833 | 3/1956 | Schenkel et al. | 52/67 X |
| 2,880,902 | 4/1959 | Owsen | 220/8 |
| 3,248,830 | 5/1966 | Maynard | 52/67 |
| 3,321,876 | 5/1967 | Birkenheyer | 52/67 X |
| 3,513,605 | 5/1970 | Smith | 43/1 |
| 3,526,066 | 9/1970 | Hager et al. | 52/27 |
| 3,555,748 | 1/1971 | Herman | 52/67 |
| 3,629,875 | 12/1971 | Dow et al. | 4/599 |
| 3,832,810 | 9/1974 | Johnston | 52/67 |
| 3,835,809 | 9/1974 | Harding | 4/459 |
| 3,940,806 | 3/1976 | Mustee | 4/146 |
| 4,035,964 | 7/1977 | Robinson | 52/66 |
| 4,065,885 | 1/1978 | Blick | 52/143 |
| 4,123,869 | 11/1978 | Witt | 43/1 |
| 4,163,294 | 8/1979 | Patterson | 4/111 |
| 4,224,754 | 9/1980 | Derryberry | 135/901 |
| 4,305,164 | 12/1981 | Sargent | 4/462 |
| 4,380,836 | 4/1983 | Braxton | 4/460 |
| 4,539,721 | 9/1985 | Moore | 4/613 |
| 4,574,969 | 3/1986 | Mays | 220/8 |
| 4,682,436 | 7/1987 | Ritson | 135/901 |
| 4,726,155 | 2/1988 | Nahimias | 52/71 |
| 4,761,908 | 8/1988 | Hayes | 43/1 |
| 4,785,590 | 11/1988 | Jones | 52/67 X |
| 4,825,578 | 5/1989 | Robinson | 135/901 X |
| 4,883,813 | 5/1989 | McLemore | 135/901 |
| 4,909,268 | 3/1990 | Maggio | 135/902 X |

FOREIGN PATENT DOCUMENTS

| | | | |
|---|---|---|---|
| 527558 | 10/1940 | Belgium | 4/600 |
| 2410717 | 6/1979 | France | 52/67 |
| 4205 | 1/1900 | United Kingdom | 4/600 |
| 1339915 | 12/1973 | United Kingdom | 52/67 |

*Primary Examiner*—Henry K. Artis

[57] ABSTRACT

A multi-purpose shelter adapted for use as a toilet, shower or changing enclosure of such size as to accommodate a person, has in a sectional embodiment a floor with ventilation and drainage slots surrounded by a cylindrical truncated shell containing a plurality of pliable wall sections of progressively reduced diameters which may be raised in a telescopic manner, held free-standing in an extended position by friction, is quickly and easily set up on site without tools for special instruction and collapsible into a low profile form for quick and easy transportation, storage or shipment.

7 Claims, 3 Drawing Sheets

COLLAPSIBLE PRIVACY SHELTER

BACKGROUND OF THE INVENTION

The field of this invention pertains to portable building structures and, in particular, to collapsible shelters for use as changing rooms and toilet enclosures of the type commonly seen at beaches, special events, parks, construction sites, and also those of modular or collapsible design as cited below.

A collapsible portable shelter can be used for privacy aboard small watercraft, at campsites and other public places where conventional portable toilet shelters are impractical due to their large size, weight, or hardware components necessary to assemble into a self supporting structure, making them inconvenient, unsuitable and impractical aboard small boats, campers and similar recreational vehicles and vessels due to a lack of space.

Examples of present portable toilet and shower structures are disclosed in U.S. Pat. Nos.: 4,493,118 Braxton, 4,305,164 Sargent, 4,726,155 Nahmias, 4,539,721 Moore, 4,163,294 Patterson, 4,065,885 Blick, 4,035,964 Robinson, 3,526,066 Hagar, 3,940,806 Mustee and 1,917,629 Anderson.

Other examples of portable shelters fall into the classification of hunting blinds, including U.S. Pat. Nos.: 3,513,605 Smith, 4,123,869 Witt, 4,682,436 Ritson, 4,825,578 Robinson, 4,761,908 Hayes and 4,833,813 McLemore.

Articles of sectional and telescopic side wall configuration are described in U.S. Pat. Nos.: 2,880,902 Owsen and 4,574,969 Mays.

No previous privacy shelter is as portable, versatile and convenient in use, particularly on watercraft or land vehicles, as is the present invention.

SUMMARY OF THE INVENTION

The present invention comprises a novel feature in the field of portable toilet and changing shelters in providing a collapsible, freestanding, lightweight and hand-carried enclosure. The purpose of a portable collapsible enclosure is to provide privacy and to eliminate the inconvenience of having a fixed, bulky enclosure where space is essential, unavailable or impractical for common portable toilet stalls due to their large size and number of structural components necessary to support the framework. These conventional toilet stalls often require tools, hardware and special instruction to erect and disassemble.

The present invention provides an article of simplicity, comprising a series of telescopic rings which are capable of manufacture on the current market with current means and materials.

This invention is designed to serve particularly on board small boats and at recreational areas as a simple, inexpensive, lightweight, portable, attractive, durable, freestanding, collapsible shelter. The shelter is comprised of a series of telescopic sections which may be quickly erected on site for use, having a large inside volume capacity when extended, and is easily collapsed into a compact form for carrying, storage, transportation and shipping.

The fabrication elements used for the manufacture of this invention may be of plastic or other suitable pliable material through a blow mold process. The primary requirement is that the wall provide the strength and durability necessary to serve the purposes of the invention.

DESCRIPTION OF THE PREFERRED EMBODIMENTS

Figure 1:
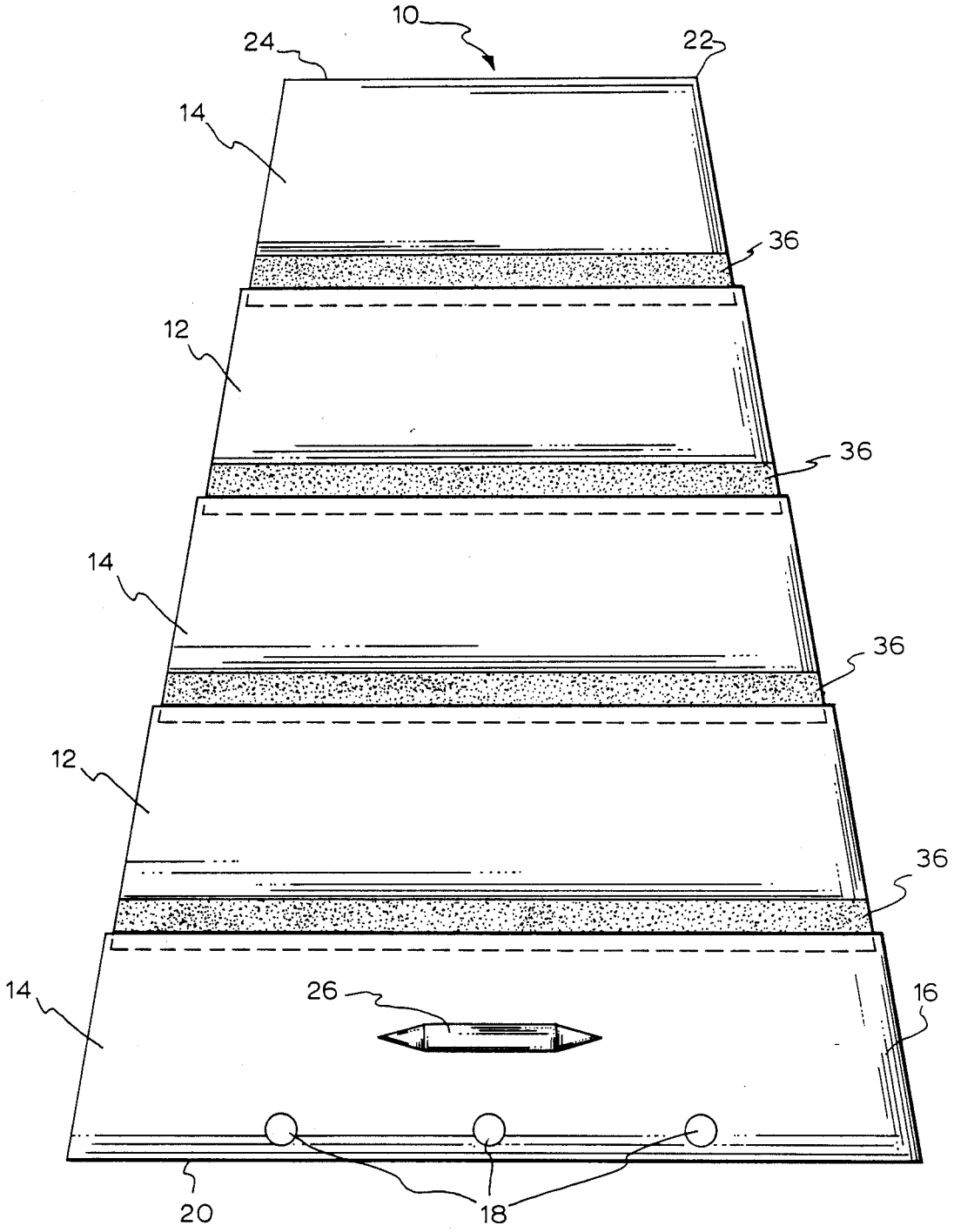
FIG. 1 is a sectional view of the collapsible privacy shelter showing the embodying features in its fully extended position.

FIG. 1 illustrates the novel collapsible privacy shelter in the general direction of arrow 10 which includes a truncated base 16 with a body made up of a plurality of wall sections 12 and 14, said sections alternating within the other. The sections are coaxially disposed with respect to one another and presents a continuous sidewall which is slightly tapered inward so that sections 12 fit externally about the sidewall of sections 14, each of which are of successively decreasing diameter. However, as the lower portion of sections 12 merge with the upper portion of sections 14, the opposing wall surfaces of the sections engage in a frictional fit so that the sections will be maintained in an extended position as illustrated.

Because of the large size of the shelter in its extended form, combined with the weight of the telescopic sections, a further improvement which substantially adds to the strength of the extended numerous telescopic sections includes a sealing means 36 disposed between the opposing surfaces. This sealing means takes the form of adhesive strips of tape 36 arranged in a band or band-like fashion around all binding frictional support surfaces. The tape 36 is preferably adhesively attached to the external or internal, lower or upper surfaces, of all sections which bind to support the invention 10 and thus present a smooth cushioned or resilient surface to the inside surface of the alternating sidewalls of the panels.

In this manner, frictional engagement will hold the plurality of the article 10 together once pressure upward is applied. When it is desired to release connection, the upper sections 12 and 14 may be forced downward to separate the sections. The sealing means 36 not only insures a good bind between the panels 12 and 14, but forms a seal to help prevent failure, collapse or, alternately, unintentional separation by serving as stops.

The uppermost section 22 includes two grips, or handles 34 (not in view) affixed thereto, each being on opposite sides of the inside of the section 14 and 22. The handles 34 take the form of lifting grips securely mounted about the upper portion of the top panel so they may be easily grasped by the hands of the user for raising the shelter to its extended position. When it is desired to extend the sections into the upward position, the user merely tugs upward on the handles 34 which forcibly urge the inside surface of the lower edge marginal region of the lower sections 12 and 14 to frictionally engage and bind with the upper edge marginal regions 36 of the unit 10. To disengage or release the sections, a slight tap or blow is directed atop the upper edge of section 14 and 22 which will drive the sections downward over the alternating panels so that the sections become nested together in a collapsed and uniform condition inside the case 16. Although only five sections are illustrated, it is to be understood that less or additional sections may be incorporated, depending upon the height desired.

A single handle 26 is shown affixed to the case shell outer wall 16 for convenience in hand-carrying the invention when collapsed.

Drainage and/or ventilation holes 18 are arranged at intervals around the lower portion of the base 16 and commode 28.

Figure 2:
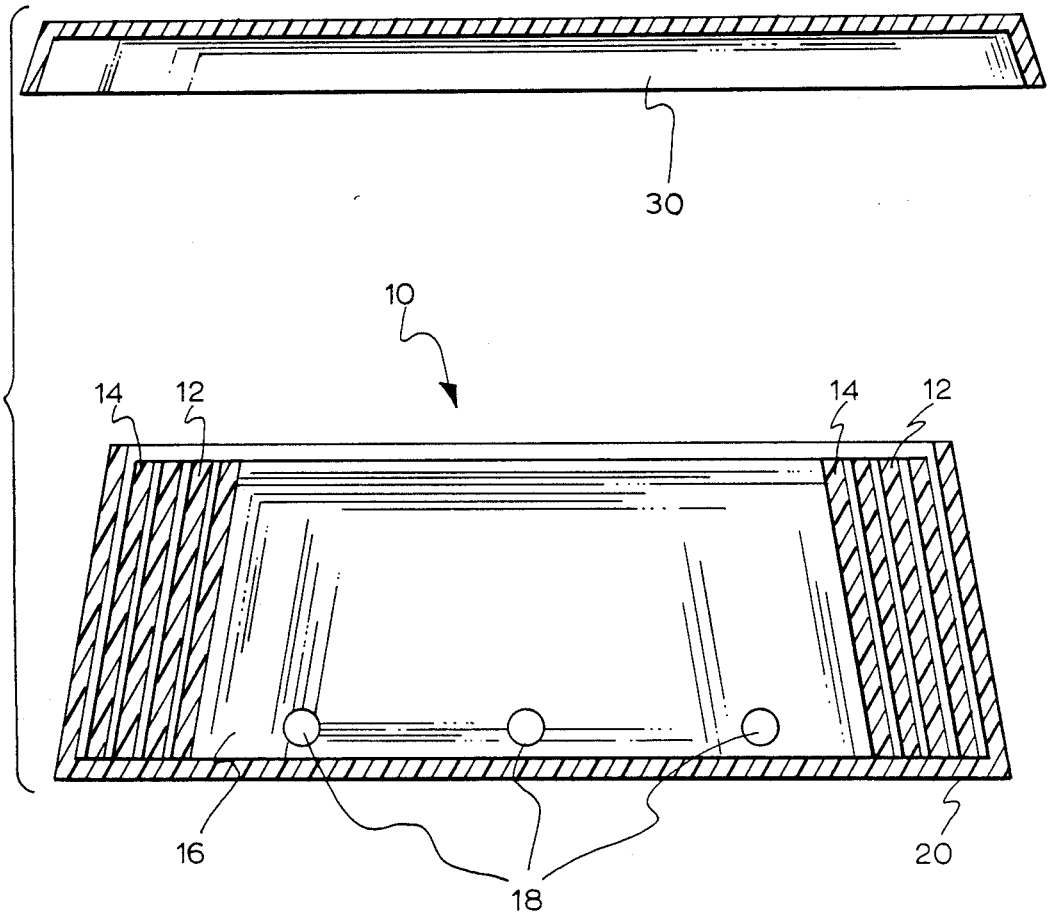
FIG. 2 is a sectional view of the shelter illustrated in FIG. 1 when in a fully collapsed position.

FIG. 2 illustrates the shelter in its collapsed position as opposed to the extended position as shown in FIG. 1. In the collapsed position the assembly is unitized since the outer sections 12 cannot be disengaged from the inner sections 14 or bottom case 16. Therefore, the height of the total assembly is greatly reduced from the extended position and a unitized assembly is maintained. Furthermore, the stop means 20 prevents the upper sections 12 and 14 from disengaging therewith. Also, the height of sections 12 and 14 are shorter or of lesser dimension in height than the bottom section or case 16.

The case lid 30 is of slightly greater diameter than the outside of the case shell 16, which may be provided with a downwardly flange or foot which may be snap-locked into engagement with a receptacle or groove about the uppermost portion of the case 16, providing a stop means to secure the panels 12 and 14 in place, and to cover the aperture in its entirety.

Figure 3:
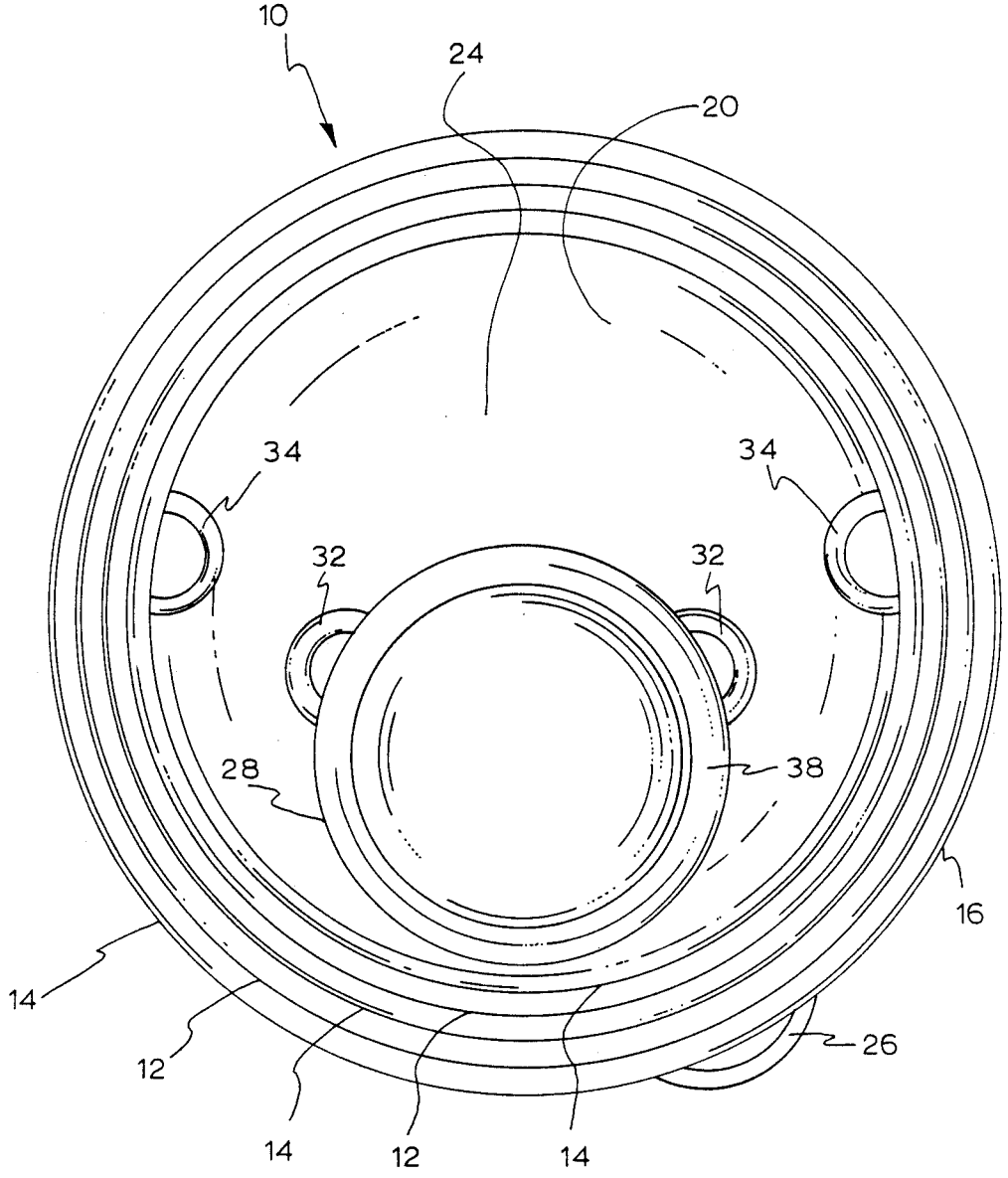
FIG. 3 is a view of the shelter illustrated in FIGS. 1 and 2 viewed from top dead center with the cover out of view.

FIG. 3 illustrates the privacy shelter from top dead center without the lid 30 in view. This perspective shows a configuration of the shelter 10 in a collapsed position illustrating the case 16 and floor 20. The commode 28 has a seat 38 and support handles 32 affixed for safety and stability when in use aboard watercraft in rolling waters or recreational vehicles in motion. The commode unit is set off center to the aperture 24 with a series of panels 12 and 14 nested in an aligned condition on the floor 20 in alternating decreasing diameters. A case handle 26 is affixed to the outside shell 16.

Lift handles 34 are affixed to the innermost panel section 14 and 22, one on each side, which provide grips to raise the unit 10 to an extended position and to lower it into a collapsed position.

SUMMARY

While particular embodiments of the invention have been shown and described, it will be obvious to those skilled in the art that changes and modifications may be made without departing from this invention in its utility and, especially, support aspects. Therefore, the aim in the following claims is to cover all such modifications as may fall within the true spirit and scope of this collapsible privacy shelter.

I claim:

1. A collapsible shelter useful as a toilet, shower or dressing structure, comprising, a base shell with a floor composite therewith, a collapsible structure made in a single molding operation from a semiflexible material comprising a generally tubular body having a plurality of tapered wall sections coaxially disposed with respect to each other, each of said tapered wall sections having an upper portion and a lower portion arranged in successively diminishing diameters which means that they telescopically fit into one another, each of said tapered wall sections being tapered so that the lower portion of one section binds with the upper portion of the next adjacent section so as to form a unit and provide a maximum volume inside the enclosure and, sealing means disposed between each adjacent and binding portions of said sections to thereby provide a releasable frictional engagement therebetween, said tapered wall sections being further characterized as nestable in a normal condition to provide a low profile for storage purposes and being upwardly extendable to a usable condition to constitute a maximum volume enclosure, the collapsible structure having sufficient inside dimension to accommodate a person in the enclosure when extended, a commode affixed to said shell base floor, and a lid for attachment to the uppermost portion of said base shell when in the normal collapsed condition.

2. The collapsible structure of claim 1, whereby each of of the tapered wall sections may be moved upward in a telescopic manner and whereby the lower portion of one section and the upper portion of the adjacent section engage in a frictional manner to combine all sections as a unit, in an extended freestanding position, thereof constituting a maximum volume shelter, said binding or frictional portions at the upper portion of one taped wall section and the lower portion of each alternate adjacent tapered wall section having tape or other resilient composition which is characterized as being compressible and adhesively affixed to said frictional binding portions of contact where each tapered wall section connects to effect a super binding seal between said adjacent and binding portions of the tapered wall sections.

3. The collapsible shelter of claim 1, wherein the uppermost tapered wall section when extended and the innermost tapered wall section when collapsed having handles affixed at opposite sides on the inside wall to serve as aids in raising the shelter walls to an extended position and lowering the shelter walls to a collapsed position.

4. The collapsible shelter of claim 1, further including means for engagement atop the uppermost part of the base shell to thereby provide a flange and stop which is of equal proportion to the perimeter of the lid, whereby said flange serves to couple the lid to the upper perimeter of the base shell.

5. The collapsible shelter of claim 1, wherein the base shell has secured to its outside surface, a handle for manual engagement by a user for hand-carrying the collapsed, closed shelter, said base shell having slots at intervals along the lower portion thereof about the entire perimeter of the shelter to serve as drainage and ventilation means.

6. The collapsible shelter of claim 1, wherein, the shelter components are formed of plastic material.

7. The collapsible shelter of claim 1, wherein the commode is attached to the shell base floor via adhesives or common fasteners and, having handles or grasping means affixed at each side thereof.

* * * * *